US010112689B2

(12) United States Patent
Parker

(10) Patent No.: US 10,112,689 B2
(45) Date of Patent: Oct. 30, 2018

(54) WATERCRAFT POSITIONING SYSTEM

(71) Applicant: John Richard Parker, West Chester, PA (US)

(72) Inventor: John Richard Parker, West Chester, PA (US)

( * ) Notice: Subject to any disclaimer, the term of this patent is extended or adjusted under 35 U.S.C. 154(b) by 0 days.

(21) Appl. No.: 14/821,485

(22) Filed: Aug. 7, 2015

(65) Prior Publication Data

US 2016/0159447 A1 Jun. 9, 2016

Related U.S. Application Data

(60) Provisional application No. 62/034,662, filed on Aug. 7, 2014.

(51) Int. Cl.
*B63C 3/02* (2006.01)
*B63C 3/12* (2006.01)
*B63C 3/06* (2006.01)

(52) U.S. Cl.
CPC ..... *B63C 3/02* (2013.01); *B63C 3/06* (2013.01); *B63C 3/12* (2013.01)

(58) Field of Classification Search
CPC .... B63C 3/02; B63C 3/06; B63C 3/12; B63C 3/04; B63C 1/04; B63C 1/00; B63C 3/08; B63B 23/30; B65G 13/11; B60P 3/1066; B60P 3/1033; B60P 1/52
USPC ..... 405/1, 2, 3, 4, 7; 212/307, 309, 317, 212/321, 322, 224, 245
See application file for complete search history.

(56) References Cited

U.S. PATENT DOCUMENTS 3,856,168 A * 12/1974 Mauck ..... B60P 3/1058 414/478
3,888,367 A * 6/1975 Cox ..... B60P 3/1066 280/414.1
4,363,590 A * 12/1982 Crate ..... B60P 3/1033 280/414.1
5,449,247 A * 9/1995 Smith ..... B63C 3/02 405/3
5,636,587 A * 6/1997 Klimowicz ..... B63B 23/00 114/259
5,988,941 A * 11/1999 Sargent ..... B63C 3/06 114/48
8,424,479 B1 * 4/2013 Caccamo ..... B63C 3/02 114/259
2003/0101920 A1 * 6/2003 Foxwell ..... B60P 3/1066 114/344
2003/0209877 A1 * 11/2003 Beyer ..... B60P 3/1066 280/414.1
2005/0002767 A1 * 1/2005 Oosterhouse ..... B60P 3/1033 414/498
2009/0044739 A1 * 2/2009 Imel ..... B63C 3/02 114/263
2011/0243663 A1 * 10/2011 Smith ..... B63C 1/02 405/3

(Continued)

FOREIGN PATENT DOCUMENTS

WO WO 2013/191570 * 12/2013

*Primary Examiner* — Carib A Oquendo
(74) *Attorney, Agent, or Firm* — Laurence Weinberger

(57) ABSTRACT

Modifications to the lifting structure of prior art boat lifts permit the addition of support and drive rollers and associated drive mechanisms that may be used to displace the bow (or stern) of a raised boat over an adjacent barrier such as a sea wall, dock, or bulkhead.

4 Claims, 5 Drawing Sheets

(56) References Cited

U.S. PATENT DOCUMENTS

2015/0183361 A1* 7/2015 Bacon ..... B60P 1/52
414/529

* cited by examiner

WATERCRAFT POSITIONING SYSTEM

Benefit of U.S. Provisional Application No. 62/034,662 filed on Aug. 7, 2014 is hereby claimed.

BACKGROUND OF THE INVENTION

Field of the Invention

The present invention moves a watercraft horizontally after a boat lift moves a boat vertically from the water for dockage and storage.

Description of Problem

Traditionally, a boat docks between pilings, and a cradle framework permits the boat to be picked vertically to a desired height above the water. The final boat position may not necessarily be the most desired position. Once docked and raised, the operator may have a need for a variety of reasons to move the boat much farther forward. For instance, while in the water, the boat could not be driven any farther forward because the bow could be too close or contact a seawall, bulkhead, dock or other structure.

The present invention may be adapted to a wide variety of docking facilities and boat configurations. A typical example of its application would be to a boat lift. Once the boat is docked and lifted vertically, the present invention can move the boat forward into a desired position with the bow very close or over a seawall, bulkhead, dock, etc. The use of the present invention can move a boat forward a considerable distance.

A problem in thousands of boating communities is that the lifts and/or docks are in very close proximity to each other. When the watercraft is docked, it must be kept within certain boundary lines with regard to neighboring facilities. Many of these communities have survey restrictions requiring a boat to stay within the surveyed lines as well as its dock and lift equipment. If the boat protrudes over the allowed limits, it will interfere with other boat operators. This greatly limits the owner's choice of not only watercraft lengths but also which particular real estate properties can be purchased that would accommodate a boat of a desired length. The present invention effectively provides a solution to this problem by allowing for a larger/longer boat to be owned and stored, Correspondingly, it also gives the boat owner a wider variety of real estate lots to purchase to accommodate the boat length.

Another example of the benefits of being able to move the boat, once lifted, either forward or backward is the ability to exactly position the boat for loading of people, cargo and maintenance. This is also very helpful for handicapped passengers or crew.

BRIEF DESCRIPTION OF THE INVENTION

Using the present invention, a watercraft, after being lifted vertically out of the water by a lift, can be moved horizontally forward and backward by the use of soft rollers, similar to the rollers used on boat trailers. The invention provides for two types of rollers. The first type of roller is securely mounted to the boat lift and designed to bear the weight of the boat. These rollers, which rotate freely, engage the hull and provide guidance and support as the boat is lifted. These rollers help the drive rollers bear the weight of the vessel and roll freely forward and backward in concert with the drive rollers. The positioning of the support rollers is determined by the style of the hull and the positioning of the propulsion equipment.

The second type of rollers are drive rollers. Drive rollers are securely mounted to the boat lift and are connected through power transfer mechanisms to a drive motor which is separate from the motors used to raise the boat. Drive rollers are connected to a drive motor by way of belts, drive shafts, drive chains or other transfer means. Depending upon the configuration required for a given hull, universal joints and transfer cases may be employed to achieve multi-directional drive capability. The positioning of the drive rollers is also determined by the style of the hull and the positioning of the propulsion equipment and will be different as disclosed below for single prop, twin prop, shaft mounted prop drives, or other forms of propulsion. The boat rests on the drive rollers that make firm contact with the hull on its sides or center keel. These rollers are fitted firmly against the hull or keel in a variety of positions, being mounted as determined by hull style and propulsion equipment.

Figure 1:
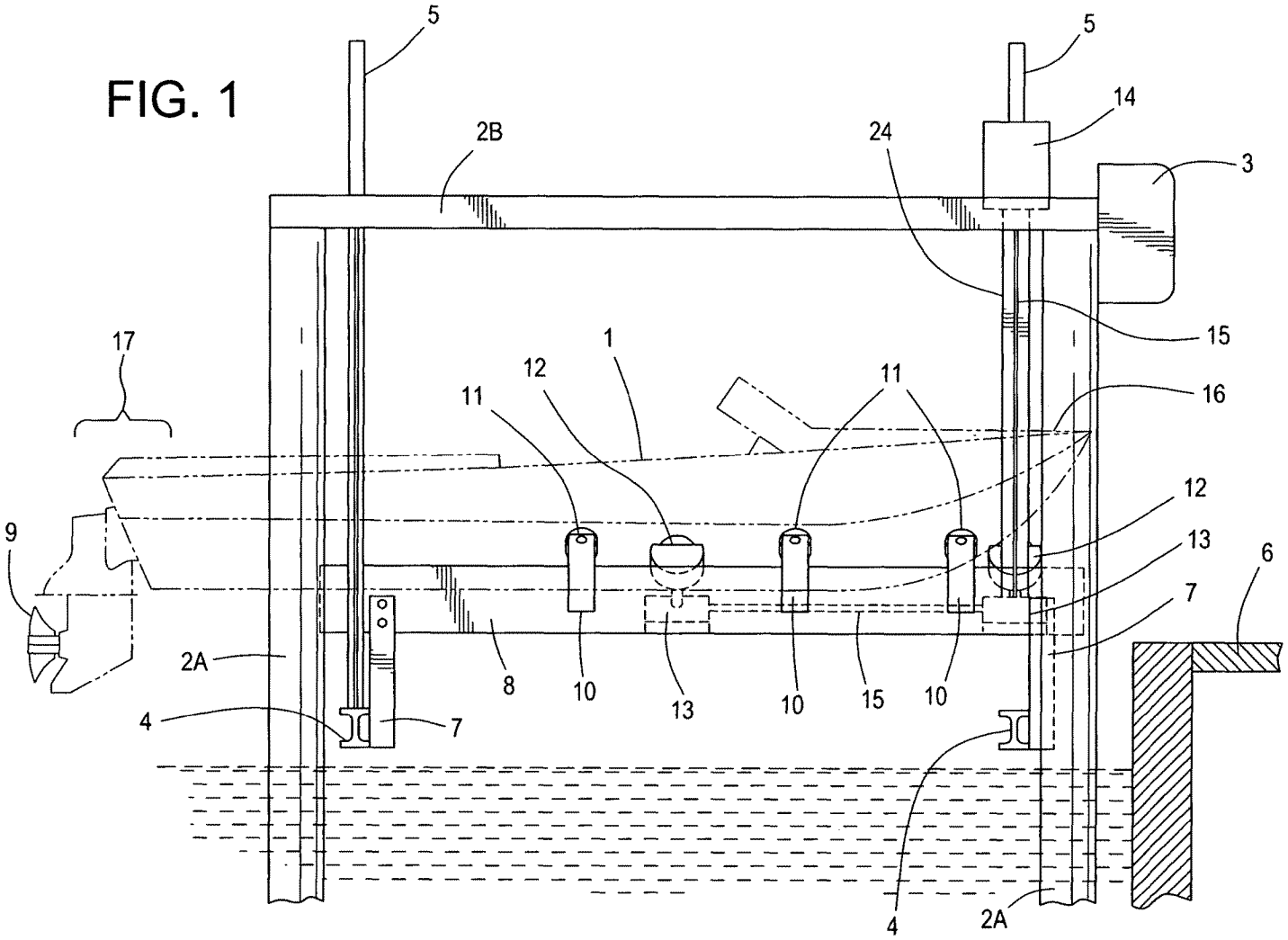
FIG. 1 shows a lateral schematic view of a single prop boat that has been raised above the water by a prior art boat lift that has been modified with the present invention.

These and other features of the invention can be understood by reference to the following description. FIG. 1 shows the basic elements of a prior art boat lift. Pilings 2A are placed approximately at the fore and aft positions of the boat 1 that is to be lifted. While only two pilings 2A are shown, a duplicate pair is located on the opposite side of the boat 1. Between the pilings conduit 2B holds part of the lift mechanism which is connected to lift motor 3. Typically, the lift mechanism is a rod around which cables 22 (FIG. 5) can wind when turned by motor 3. At each piling 2A cables 22 (FIG. 5) extend down from the conduit 2B and connect to cross I beams 4. Flexible guide poles 5 are mounted on each I beam 4 to help locate a boat properly within the lift while it floats on the water. With the boat 1 floated in place, motor 3 takes up cables 22 thereby raising the cross I beams 4 along with the boat. The boat lift keeps the boat level as it is raised. These elements and their variations in the prior art are well known and do not form part of the present invention.

To accomplish the purpose of moving a boat once lifted, the present invention significantly modifies the traditional boat lift. For a single prop boat (one in which the prop is on the centerline of the hull), FIG. 1 shows a number of support rollers 11 mounted on brackets 10 which engage the side of the hull of boat 1. Three exemplary rollers 11 are shown with the understanding that as many as are needed to support the weight of a particular boat would be used. Brackets 10 are mounted on beam 8 which runs the length of the boat lift. Beam 8 is itself mounted at some height above I beams 4 on support posts 7 which are attached to I beams 4. The reason beam 8 with brackets 10 is raised above the level of I beams 4 is to provide clearance for the boat engine and prop 9 when the boat is moved forward within the lift.

Drive rollers 12 frictionally engage the side of the hull of boat 1 and are mounted on and driven by power transfer case 13. As with support rollers 11, only two drive rollers 12 are shown with the understanding that as many as are needed to move the weight of a particular boat would be employed. Power to rotate the drive rollers 12 is provided by reversible drive motor 14. Alternatively, a hand powered winch might be employed although for a heavy boat sufficient torque may not be generated. A housing 24 extending from drive motor 14 serves to shield power transfer mechanism 15 from the elements. The transfer mechanism 15 may consist of chains, belts, drive shafts, or the like sufficient to deliver torque to one or more power transfer cases 13.

Figure 2:
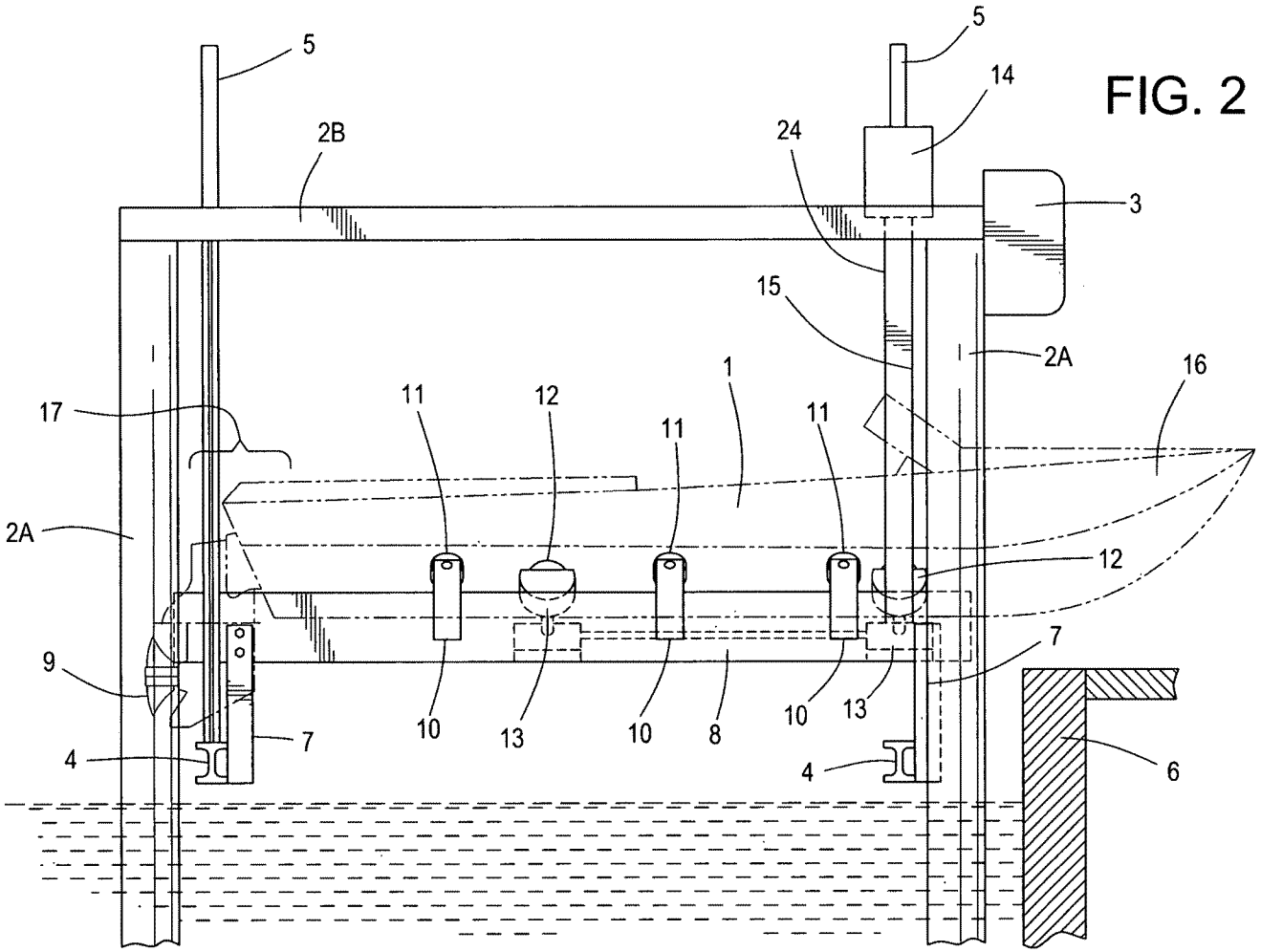
FIG. 2 shows a lateral schematic view of a single prop boat that has been raised above the water by a prior art boat lift and shifted forward by the present invention.

FIG. 2 shows boat 1 after it has been moved forward by driven rotation of drive rollers 12. The boat is moved substantially horizontally. The bow 16 of boat 1 now extends over barrier 6 which may be a sea wall, bulkhead, dock etc. Importantly, the stern 17 of boat 1 no longer extends into waters that may be used by others. It is not necessary that boat 1 be moved so far forward that its stern 17 is within the boat lift, only that the stern is moved to within a permitted area.

Figure 3:
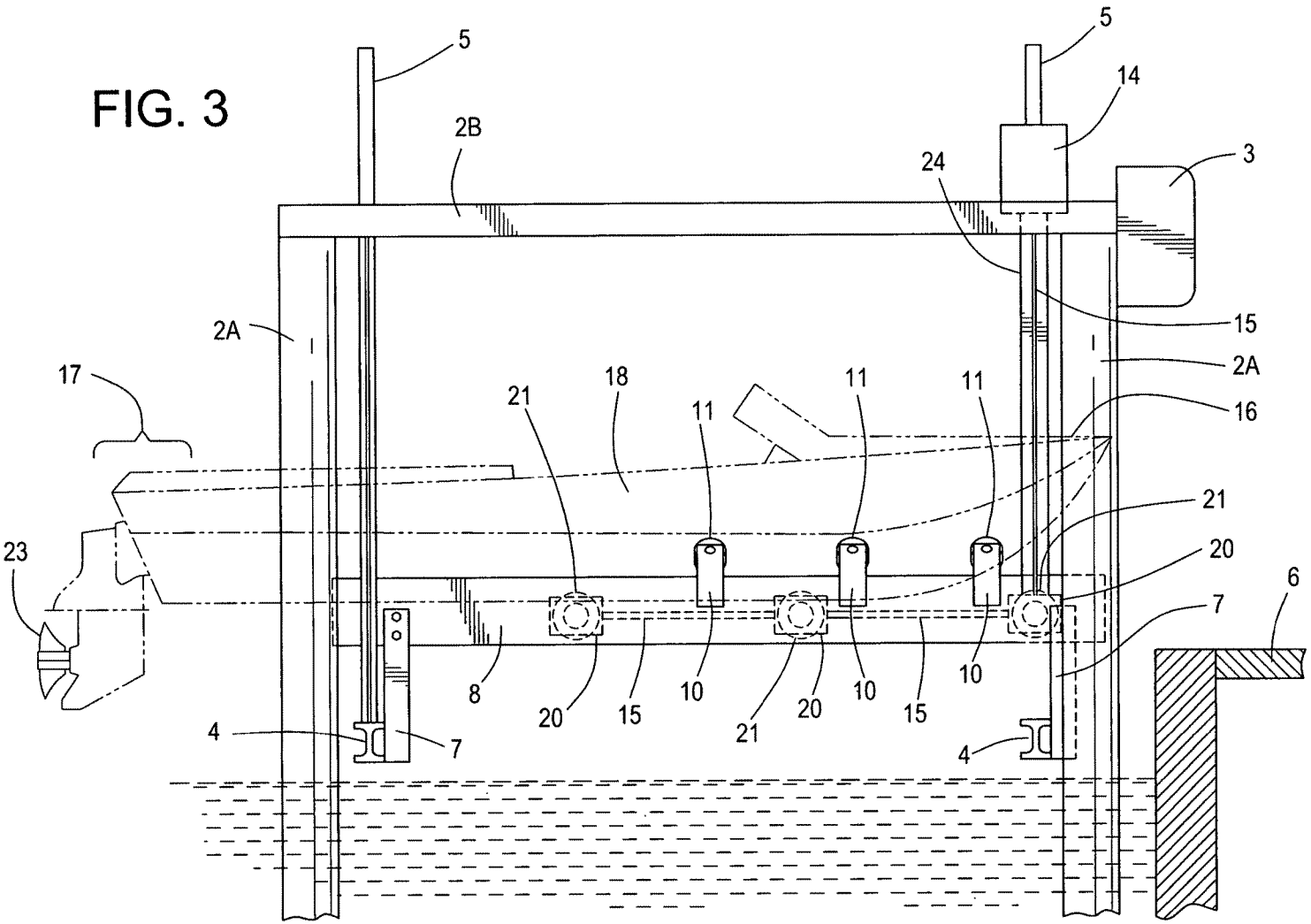
FIG. 3 shows a lateral schematic view of a twin prop boat that has been raised above the water by a prior art boat lift that has been modified with the present invention.

FIG. 3 shows an embodiment of the present invention for use with a twin prop boat 18 where the props 23 are displaced on each side of the centerline of the hull. The basic arrangement of support rollers 11 may be the same as for the single prop hull. However, drive rollers 21 are now so arranged that they engage the hull on the centerline keel of the boat 18. The number of drive rollers 21 and their associated power transfer cases 20 may vary depending on how many are needed to move the weight of a particular boat. In this embodiment, drive rollers 21 may also be used to support boat 18. Also, in this embodiment any other drive rollers 21 are also located to engage the centerline keel of the boat and the power transfer mechanism also runs along underneath the centerline of the boat.

Figure 4:
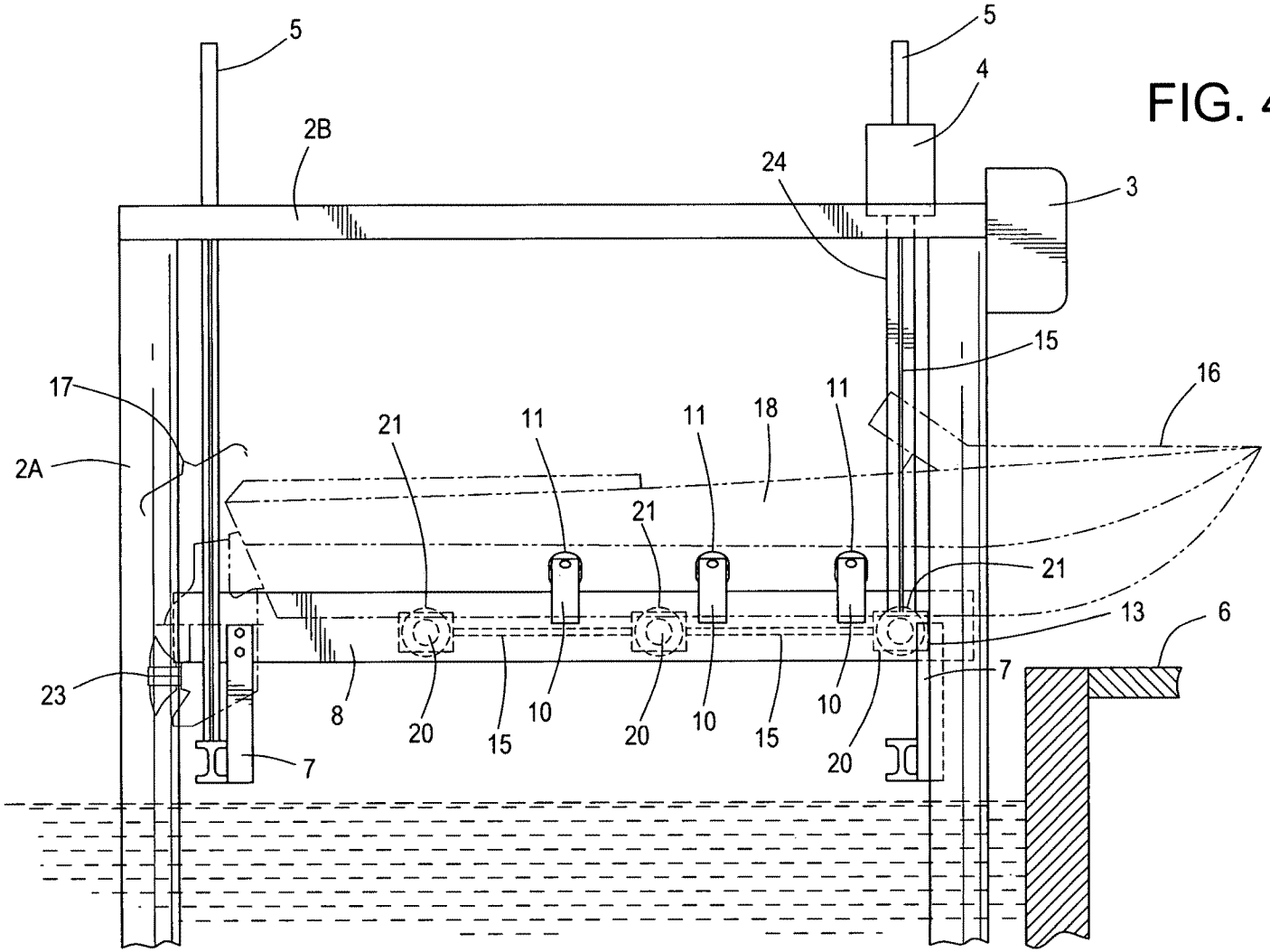
FIG. 4 shows a lateral schematic view of a twin prop boat that has been raised above the water by a prior art boat lift and shifted forward by the present invention.

FIG. 4 shows twin prop boat 18 after it has been moved forward by clockwise driven rotation of drive rollers 21. The bow 16 of boat 18 now extends over barrier 6 which may be a sea wall, bulkhead, dock etc. Importantly, the stern 17 of boat 18 no longer extends into waters that may be used by others. It is not necessary that boat 18 be moved so far forward that its stern 17 is within the boat lift, only that the stern is moved to within a permitted area.

Figure 5:
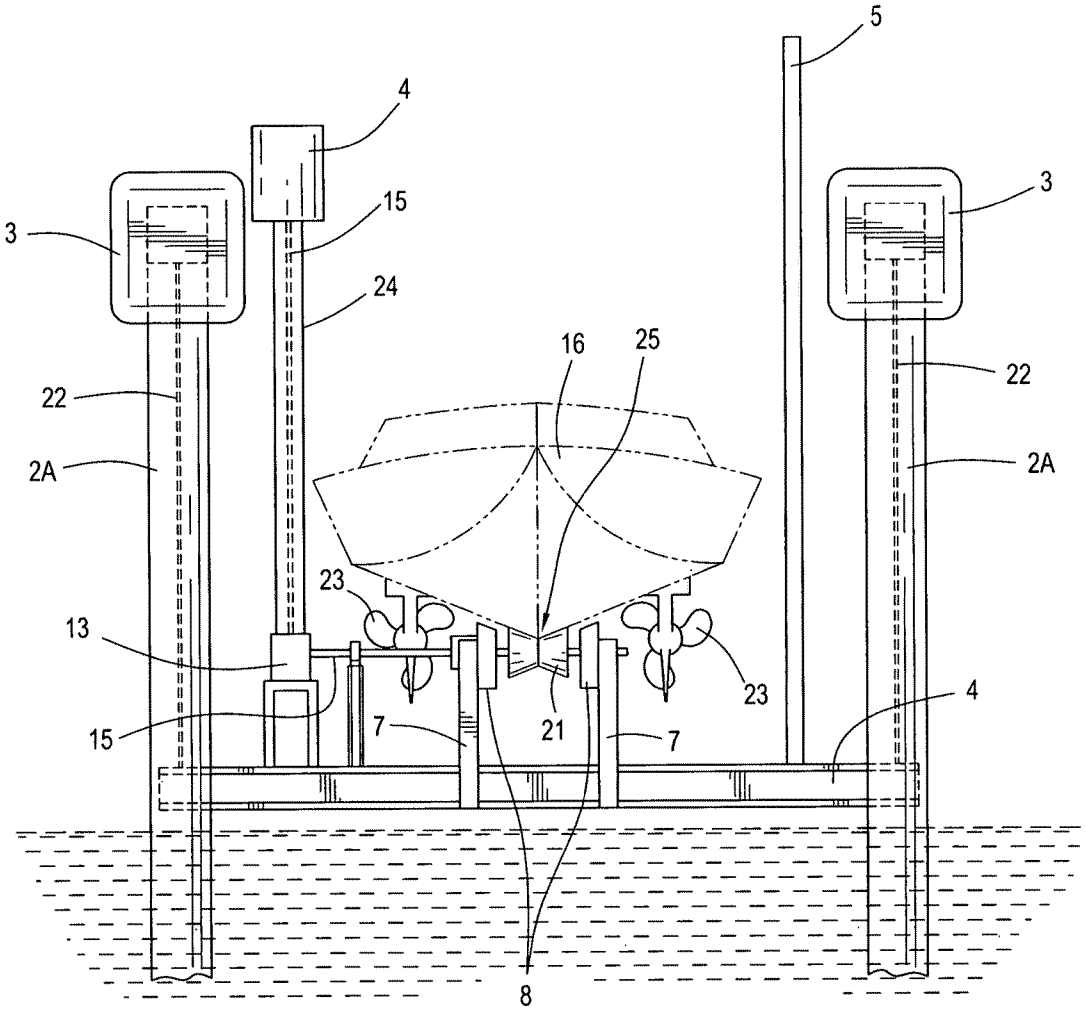
FIG. 5 shows a bow on view of the twin prop boat of FIG. 3 as it is engaged by a keel drive roller.

FIG. 5 diagrammatically shows a bow 16 view of boat 18 as it would appear located in FIG. 3 before being moved forward. The drive roller 21 engages the centerline keel 25 of boat 18. As shown in FIG. 4, another drive roller 21 may be located further astern from the roller 21 of FIG. 5. When boat 18 is moved forward, the drive rollers 21 do not contact props 23. In no event would the boat be moved so far forward that the props would engage forward transfer mechanism 15. It has been noted previously that beam 8 is raised above cross I beam 4 by supports 7 so that the props (and drives) to do not hit I beam 4 as the boat is moved forward. In the case of a boat with an inboard motor driving a long shaft and prop (not shown), a combination of side and keel drive rollers may be necessary. A keel drive roller may not be located where the drive shaft would hit it when the boat is moved forward. Depending on the boat configuration, side mounted drive rollers may be used.

In use, the invention described in this patent application works as follows. Upon a boat being floated within the boat lift (being guided and centered by the guide poles), the lift motor 3 is engaged so that I beams 4 are raised thereby raising beam 8. The support and drive rollers engage the hull as it is further lifted out of the water. Lifting is continued until the bottom of the boat is higher than the top of barrier 6. At this point, lift motor 3 may be disengaged. Drive motor 14 is engaged and the boat moved forward on freely moving support rollers by action of the drive rollers. Forward movement is continued until the desired portion of the boat extends over barrier 6. To place the boat back in the water, the process is reversed. Reversible drive motor 14 rotates the drive rollers to move the boat back so that the bow no longer extends over the barrier. Motor 14 is disengaged and lift motor 3 reversibly engaged to lower the boat back into the water.

The electric motors are designed for exterior use and capable of forward and reverse modes. If a very heavy boat needs to be moved forward, more than one drive motor may be employed to drive the rollers. The motors can be operated by wireless remote or from a stationary hardwired location. Universal joints, gear boxes and transfer boxes are used to achieve multi-directional drive train function. An example embodiment (not shown) of the need for multi-directional drive train operation would be drive rollers positioned on the opposite side of the hull from the electric drive motor. This configuration would require part of the drive train assembly to pass under the hull from the drive source to the drive roller or rollers.

As noted earlier, access to the bow of the boat is greatly facilitated when it extends over the top of the barrier making it easier to load supplies and/or crew into the boat. Alternatively, using the present invention, it is possible to back the boat in (towards the barrier), raise it, then translate the stern of the boat over the top of the barrier. This permits easy and dry maintenance access to the engine and props.

I claim:

1. For a marine watercraft with hull floating on the surface of the water, a marine watercraft lift system for raising the hull of a watercraft located near a seawall, bulkhead, pier, or other impediment out of the water comprising:

a) at least two pairs of two pilings each arranged to define a rectangular space with a piling at each corner of said space, the pilings sufficiently separated to allow a watercraft to float between the pilings;

b) a first conduit fastened to two of the pilings of one piling pair and a second conduit fastened to two pilings of the other piling pair, the conduits being so arranged that the two conduits are substantially parallel;

c) two cross beams perpendicular to the pair of pilings to which the conduits are fastened;

c) four lifting mechanisms, having upper and lower ends, each located adjacent to each of the pilings and connected at their upper end to one end of each conduit, the lower end of each lifting mechanism attached to one of the four ends of the two cross beams;

d) four support posts fastened towards the ends of each of the two cross beams;

e) two hull support beams fastened to the support posts so that each hull support beam is parallel to the conduits;

f) at least one roller bracket mounted on each hull beams;

g) at least one rotatable support roller mounted to at least one roller bracket and extending above the roller bracket to engage the hull;

h) at least one rotatable drive roller mounted to at least one roller bracket and extending above the roller bracket to engage the hull; and i) means for rotating each of the rotatable drive rollers either clockwise or counter clock wise wherein the cross beams, support posts, hull support beams, and rollers form a cradle to engage the watercraft as the lifting mechanisms raises the watercraft clear out of the water to enable the rotatable drive rollers and displace the watercraft.

2. The marine watercraft lift of claim 1 in which the means for rotating the rotatable drive rollers comprises:

a) a power transfer case that engages the drive roller;

b) a reversible drive motor; and c) a power transfer mechanism to transfer power from the reversible drive motor to the power transfer case.

3. A method of using the marine watercraft lifting system of claim 1 with marine watercraft having a bow and stern located adjacent to a seawall, bulkhead, pier, or other impediment comprising the following steps:

a) employing the lifting mechanism to lift the watercraft so that the bow of the watercraft is above the seawall, bulkhead, pier, or other impediment; and b) powering the drive rollers to displace the bow of the watercraft hull over the seawall, bulkhead, pier, or other impediment.

4. A marine watercraft lift system for raising watercraft located near a seawall, bulkhead, pier, or other impediment out of the water having a hull with a bow and stern out of the water comprising powered hull support rollers that can be rotated clockwise and counter clock wise to move the hull forward or backward once the hull is out of the water.

* * * * *